US008328557B2

(12) United States Patent
Preston et al.

(10) Patent No.: US 8,328,557 B2
(45) Date of Patent: Dec. 11, 2012

(54) SIMULTANEOUS MULTI-SOURCE SCANNING FOR SECTORIZED SIMULATED PROJECTILE TRAJECTORIES

(75) Inventors: Steven Preston, Winter Springs, FL (US); Thomas H. Penner, Apopka, FL (US); Thomas C. Penrose, Oakland, FL (US); James A. Frey, Ocoee, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 349 days.

(21) Appl. No.: 12/684,761

(22) Filed: Jan. 8, 2010

(65) Prior Publication Data

US 2011/0311950 A1 Dec. 22, 2011

(51) Int. Cl.
*F41G 3/26* (2006.01)

(52) U.S. Cl. ..... 434/21; 434/11; 434/22

(58) Field of Classification Search ..... 434/11–27
See application file for complete search history.

(56) References Cited

U.S. PATENT DOCUMENTS 4,315,689 A * 2/1982 Goda ..... 356/141.1
6,549,872 B2 * 4/2003 Bollweg et al. ..... 702/158

* cited by examiner

*Primary Examiner* — Timothy A Musselman
(74) *Attorney, Agent, or Firm* — Jetter & Associates, P.A.

(57) ABSTRACT

A set of light generating devices provide simultaneously emission of a first modulated light beam and at least a second modulated light beam. The set of light generating devices are positioned so that their respective light beams are incident on the scanning mirror at different elevation angles. A photodetector detects reflected light from the target. A simulation controller is coupled to receive data obtained from the reflected light to generate a scan control signal based on the receive data and a projectile trajectory path for the projectile to the target. The scan control signal sequentially scans the elevation angle of the scanning mirror so that the respective light beams simultaneously scan different sectors of the simulated trajectory path to obtain a simulation that represents the projectile trajectory path.

21 Claims, 3 Drawing Sheets

SIMULTANEOUS MULTI-SOURCE SCANNING FOR SECTORIZED SIMULATED PROJECTILE TRAJECTORIES

FIELD

Disclosed embodiments generally relate to training and interactive simulations including combat training.

BACKGROUND

Training can enhance the skill of individuals by repetition and developing appropriate responses to various situations. In the combat context, combatants may conduct various types of training exercises in order to prepare for scenarios that can be anticipated in actual combat situations. Similar activities are performed during interactive game scenarios for entertainment purposes.

The Multiple Integrated Laser Engagement System (MILES) is a system designed for combatants involved in training exercises in order to provide a realistic training battlefield environment. The MILES system includes simulated offensive weapons, such as firearms, that provide tactical engagement simulation for direct fire force-on-force training by emitting relatively harmless near infrared (e.g., eye-safe) line-of-sight "bullets" generated by one or more light emitting diodes (LED) or lasers.

The "bullets" are sent in the form of pulses that transmit weapon information to the target. These pulses are transmitted each time the weapon is fired with a blank or blanks to simulate the firing of an actual round or multiple rounds. An audio sensor or a photo-optic sensor typically detects the firing of the blank round(s) and in real-time energizes an LED or a laser to emit the beam of "bullets" toward the target which is in the conventional sights of the weapon.

In a known apparatus for firing simulation, referred to as a two-way simulator that utilizes a practice firing device operating with laser or LED pulses, a laser or LED pulse transmitter is secured to the barrel of the gun and its transmitted pulse sequence reaches a target through the manual aiming of the gun at the target by a gunner. If the gunner perceives the aiming process as being correct, he or she actuates the trigger of the gun. This initiates an automatic process in which a transmitter control switches on the laser or LED transmitter for a duration of typically a few milliseconds.

The laser or LED pulses impact retro-reflectors on the target, and are reflected onto a position-sensitive photodetector affixed to the gun barrel. A range calculator calculates the target range from the transit time of the reflected pulses. An angular-position calculator simultaneously determines the angular deviation between the bore axis of the barrel and the center of gravity of the reflected laser or LED radiation. A flight-time calculator determines the theoretical projectile flight time. Over the course of the projectile flight time, the laser or LED transmitter transmits a further pulse sequence, and the angular-position calculator recalculates the angular deviation between the bore axis and the center of gravity of the laser radiation.

As known in the art, when laser or LED-based training is incorporated to simulate a weapon firing a projectile, the transmitted beam travels in a straight line path, which does not match the non-linear trajectory of the projectile, such as the arc-like trajectory of a bullet. In order to simulate the trajectory of the projectile, the laser or LED beam must be depressed sequentially to scan the trajectory to simulate the depression associated with the projectile trajectory.

SUMMARY

This Summary is provided to comply with 37 C.F.R. §1.73, presenting a summary of the invention to briefly indicate the nature and substance of the invention. It is submitted with the understanding that it will not be used to interpret or limit the scope or meaning of the claims.

Sequentially depressing the transmitted laser or LED beam to scan a projectile trajectory during conventional combat training simulations or interactive gaming situation can take a significant period of time, on the order of 1 second or more, particularly if the laser or LED encoding (i.e. modulating) method used is slow, such as when using the MILES encoding scheme (adopted by the U.S Army). During this period of time, the Inventors have recognized that the weapon may be inadvertently moved from its intended aim point, and thus may be moved off target well before the scanner can direct the transmitted laser or LED beam to the locations needed to obtain a simulation that accurately traces the trajectory path of the projectile.

Disclosed embodiments include firing simulation apparatus comprising a plurality of light generation devices for simultaneously emitting at least a first and a second modulated light beam, where the plurality of light generation devices are positioned so that their respective beams are both incident on a scanning mirror which reflects the beams toward the target. By sectorizing the simulated trajectory path, and wherein each light generation device simultaneously scans a different sector, the period of time to complete the scan is divided by the number of light generation devices deployed, such as ⅓ of the time for an embodiment having 3 light generation devices.

Disclosed embodiments solve another problem recognized by the Inventors that can adversely affect conventional military training simulations. The light beam starts very small upon emission (e.g., a dimension of several mms) and gets larger (more diffuse) as the distance increases. In contrast, a projectile kill radius stays constant throughout the flyout time.

To address this problem, in one disclosed embodiment, referred to herein as the "multi-divergent embodiment," the beam divergence of the light generation device that traces a relative close sector is made relatively large (e.g., using a small aperture) for and the beam divergence for the light generation device that traces relatively a far away sector is made relatively smaller (e.g., using a large aperture). This embodiment uses the fact that a light beam, such as a laser or LED beam, that is focused to a small spot will spread out quickly as it moves away from the focus, while a large-diameter beam can stay roughly the same size over a substantially longer distance. This feature allows the hit profile along the trajectory path to be more similar to an actual projectile profile as compared to scanners without this feature. It is noted that this multi-divergent embodiment is not possible in conventional military training simulators since such simulators provide only a single laser or LED.

BRIEF DESCRIPTION OF THE DRAWINGS

FIG. 4A is a diagram showing a general trajectory path of a projectile in the case of a bullet while

DETAILED DESCRIPTION

Figure 1A:
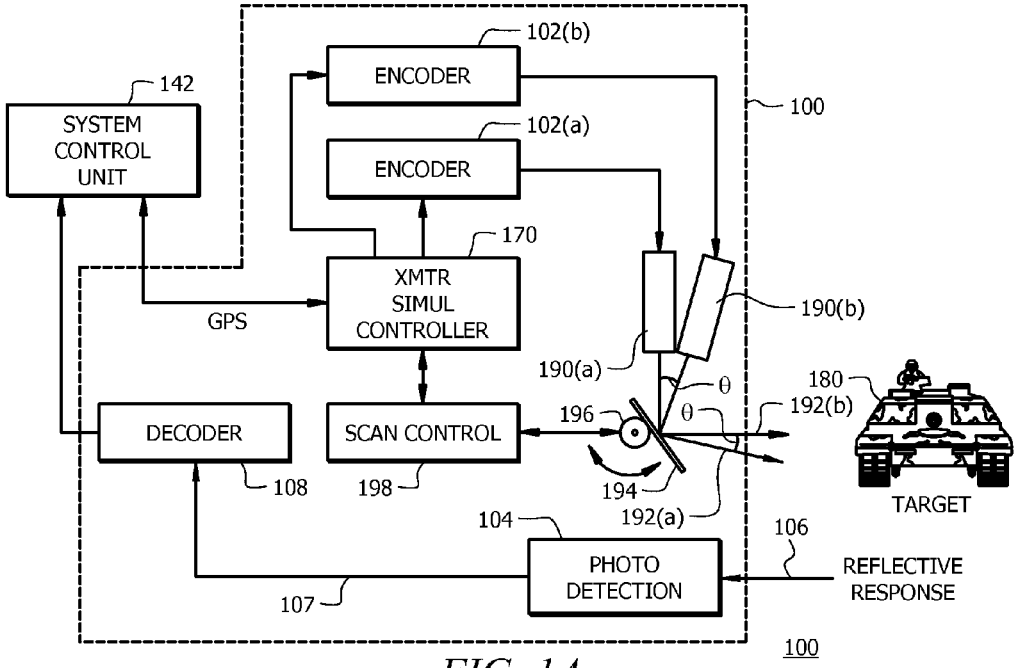
FIG. 1A is a block diagram of an exemplary firing simulation apparatus having a plurality of light generation sources in an offset pattern that provides multi-source scanning for simulating projectile trajectories, according to a disclosed embodiment.

Disclosed embodiments are described with reference to the attached figures, wherein like reference numerals are used throughout the figures to designate similar or equivalent elements. The figures are not drawn to scale and they are provided merely to illustrate the disclosed embodiments. Several aspects are described below with reference to example applications for illustration. It should be understood that numerous specific details, relationships, and methods are set forth to provide a full understanding of the disclosed embodiments. One having ordinary skill in the relevant art, however, will readily recognize that the disclosed embodiments can be practiced without one or more of the specific details or with other methods. In other instances, well-known structures or operations are not shown in detail to avoid obscuring the disclosed embodiments. The disclosed embodiments are not limited by the illustrated ordering of acts or events, as some acts may occur in different orders and/or concurrently with other acts or events. Furthermore, not all illustrated acts or events are required to implement a methodology in accordance with disclosed embodiments.

FIG. 1A is a block diagram of an exemplary firing simulation apparatus 100 having a plurality of light generation devices 190(*a*) and 190(*b*) and at least one scanning mirror 194 that provides multi-source scanning for simulating ballistic trajectories, according to a disclosed embodiment. In a typical embodiment, transmitter system 100 is affixed to a firing apparatus (e.g., weapon), such as a gun, using an attachment such as a muzzle. The target is shown as tank 180. As known in the art, tank 180 includes a plurality of optical retroreflectors (not shown).

Light generation devices 190(*a*) and 190(*b*) are shown arranged in an offset pattern so that upon reflection by the scanning mirror 194, or scanning mirrors more generally, have different elevation angles so that they trace different sectors of the simulated projectile trajectory. For example, light generation devices 190(*a*) and 190(*b*) can be laser or LED devices, such as laser or LED devices that emit in the infrared (IR). However, embodiments of the invention are not limited to the IR.

Light generation devices 190(*a*) and 190(*b*) each emit coherent light beams, shown as beams 192(*a*) and 192(*b*) that are directed towards scanning mirror 194. Light generation devices 190(*a*) and 190(*b*) are positioned so that their modulated light beams 192(*a*) and 192 (*b*) that are emitted are offset in elevation angle from one another by an angle shown as θ in FIG. 1. θ generally ranges from 2 to 20 degrees.

The modulated light beams 192(*a*) and 192(*b*) that are incident on scanning mirror 194 are redirected outward toward the tank 180. Scanning structure 196 is provided for adjusting at least an elevation angle of the scanning mirror 194, shown in FIG. 1 as motor 196. Although shown rotating only the elevation axis, scanning mirror 194 can be moveable about two axes (e.g., azimuthal axis as well) to permit redirection of beams 192(*a*) and 192(*b*) in both azimuthal and elevation under the control of a scan controller 198.

A transmitter simulation controller 170 accepts data from system control unit 142 typically representing GPS coordinates, TP time, etc., for use in compiling data that is encoded in optical signals for transmission to target 180. The signal encoding is then passed to the encoders 102(*a*) and 102(*b*), which are coupled to light generation devices 190(*a*) and 190(*b*), respectively, to encode (e.g., via modulation) the desired data in the modulated light beams 192(*a*) and 192(*b*).

As described above, conventional military training simulation apparatus include a single laser or LED transmitter that sequentially depress the single transmitted beam to scan a projectile trajectory can take time on the order of 1 or more seconds, particularly if the laser or LED encoding method used is slow such as the MILES encoding scheme. During this period of time the weapon may tend to be inadvertently moved from its intended aim point by the shooter, and thus may be moved off target well before the scanner can direct the transmitted laser or LED beam to the locations needed to obtain a simulation that accurately traces the trajectory path of the projectile. Disclosed embodiments significantly reduce aim point drifting and thus improve the ability for a shooter to hit (and stay on the) target problem by reducing the overall scan time by simultaneous emission of modulated light beams 192(*a*) and 192(*b*) that are offset in elevation angle on scanning mirror 194 to sectorize (i.e. divide up) the simulated trajectory path. Since each modulated light beam 192(*a*) and 192(*b*) simultaneously scans a different sector, in the case of non-overlapping scans or substantially non-overlapping scans, the period of time to complete the scan is divided by the number of light generation devices deployed, such as ½ of the time for an arrangement having two (2) light generation devices.

Apparatus 100 includes a photodetector 104, which may be embodied as single photodetector or as a photodetector array that transduces an incoming optical signal 106 from target 180 into an electrical signal 107 representation. Electrical signal 107 is coupled to signal decoder 108, which operates to decode and transfer any data present, which is provided to system control unit 142. As described above, system control unit 142 provides data to transmitter simulation controller 170 for use in compiling data that is encoded in modulated light beams 192(*a*) and 192(*b*) that are transmitted to the target 180. It is noted that analog to digital conversion (ADC), filtering and amplification of electrical signal 107 that is generally performed as known in the art, is not shown in FIG. 1A for simplicity.

Figure 1B:
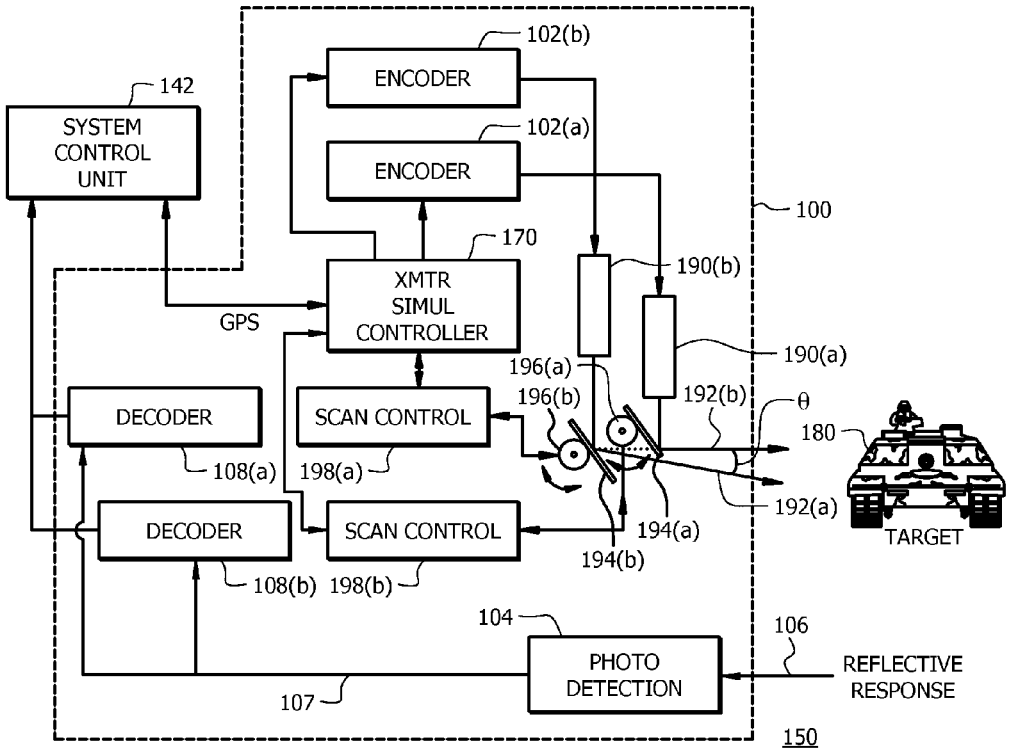
FIG. 1B is a block diagram of an exemplary firing simulation apparatus having a plurality of light generation sources and a plurality of scanning mirrors in an offset pattern that provides multi-source scanning for simulating projectile trajectories, according to a disclosed embodiment.

FIG. 1B is a block diagram of an exemplary firing simulation apparatus 150 having a plurality of light generation devices 190(*a*) and 190(*b*) and a plurality of scanning mirrors 194(*a*) and 194(*b*) in an offset pattern that provides multi-source scanning for simulating projectile trajectories, according to a disclosed embodiment. Scanning mirror 194(*a*) is scanned by scanning structure 196(*a*) and scanning mirror 194(*b*) is scanned by scanning structure 196(*b*). As in firing simulation apparatus system 100 shown in FIG. 1A, modulated light beams 192(*a*) and 192(*b*) are positioned in an offset pattern that provides simultaneous multi-source scanning.

Figure 2:
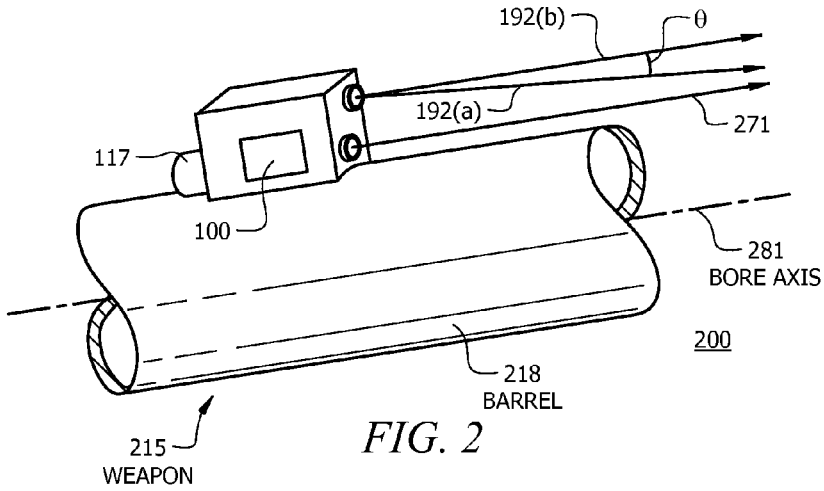
FIG. 2 is a cutout, schematic, perspective representation of a training weapon apparatus including a firing simulation apparatus that generates simulated shots showing the barrel of a weapon having a sight, according to a disclosed embodiment.

FIG. 2 is a cutout, schematic, perspective representation of a training weapon apparatus 200 including a firing simulation apparatus 100 that generates simulated shots showing the barrel of a weapon 215 having a sight, according to a disclosed embodiment. As shown in FIG. 2, a sight 117 is affixed to the barrel 218 of the weapon 215, such as a gun, so that the line of sight 271 of the sight 117 is oriented parallel to the bore axis 281 of the barrel 218, to aid in aiming the weapon 215 at the target. The line of sight 171 and the bore axis 281 are indicated in a dot-dash line. The firing of the weapon 215, such as by a combatant, is simulated by the transmission of modulated light beams 192(*a*) and 192(*b*) by the firing simulation apparatus 100 at a target, which is initiated with the actuation of a trigger or another firing initiator, such as by an audio sensor or a photo-optic sensor that detects the firing of the blank round(s) by weapon 215.

In one disclosed embodiment, the first modulated light beam is positioned to transmit along a more distant sector relative to a closer sector that the second modulated light is positioned to transmit, wherein a beam divergence of the second modulated light beam is larger than a beam divergence of the first modulated light beam. For example, the beam divergence of the second modulated light beam can be 1.5 to 8 times larger than the beam divergence of the first modulated light beam.

Figure 3:
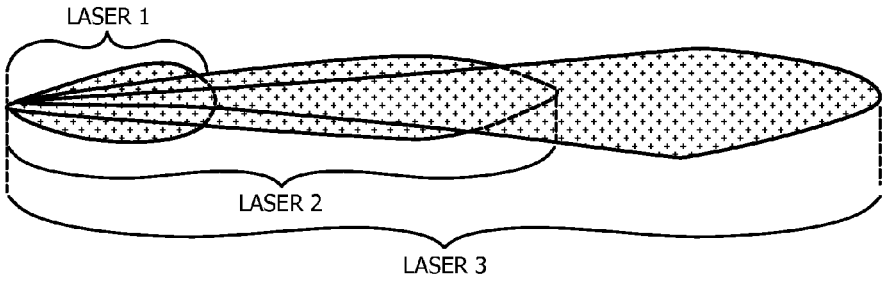
FIG. 3 is a depiction of beam pattern from an exemplary firing simulation apparatus comprising a tri-vectored scanner that includes three (3) laser sources that has the three (3) lasers aligned so that the respective beams are at a common elevation angle to demonstrate the result from having different beam divergences for the respective lasers, according to a disclosed embodiment.

In an exemplary embodiment described in more detail the Example below, the firing simulation apparatus comprised a tri-vectored scanner that includes three (3) laser sources and a single scanning mirror, wherein the three (3) lasers were aligned so that their beams were at different elevation angles relative to one another. To cover a 15 degree super elevation, the laser sources were placed with an angular separation of 5 degrees depressed relative to the adjacent laser, so that the first laser (laser 1) was placed at 0 degrees, the second laser (laser 2) at −5 degrees, and the third laser (laser 3) at −10 degrees. In this embodiment, by having multiple beam divergences so that the divergence of laser 1 is substantially larger than that of laser 2, with the smallest divergence being for laser 3, the impact width was found to stay relatively unchanged throughout the flyout space, as depicted in FIG. 3.

EXAMPLE

Disclosed embodiments are further illustrated by the following specific Example, which should not be construed as limiting the scope or content of embodiments of the invention in any way. The Example below describes a training weapon apparatus including a firing simulation apparatus comprising a tri-vectored scanner that includes three (3) laser sources that and a single scanning mirror.

The weapon selected was the MK19 which is a 40 mm Grenade Machine Gun that delivers a 40 mm projectile. The MK19 is generally an effective weapon even out to ranges requiring a 15 degree super elevation to compensate for projectile drop. In a MILES training environment, the conventional laser beam training apparatus has a beam divergence of 2 to 3 millirads (mrs) or about 0.1 to 0.2 degrees. The minimum time for a message to stay on the target is thus 7.2 ms. For the conventional laser beam training apparatus comprising a single laser and a conventional scanner to cover the 15 degrees and simulate the entire trajectory path of the projectile, using the minimum time for the message to stay on target of 7.2 msec, would take over a second (7.2 msec×15/0.1 degrees). A soldier cannot generally hold the barrel of the weapon, such as a MK19, still for a period of time on the order of one second, so that a scan covering 15 degrees would not be able to be simulated accurately.

The three (3) lasers in the training weapon apparatus including a firing simulation apparatus comprising a tri-vectored scanner were aligned so that their respective beams were at different elevation angles relative to one another. For example, to cover 15 degree super elevation, laser sources were placed with an angular separation of 5 degrees depressed relative to the adjacent laser. The first laser (laser 1) was placed at 0 degrees, the second laser (laser 2) at −5 degrees, and the third laser (laser 3) at −10 degrees. Such an arrangement takes only about ⅓ of a second for the scan from 0 degree down to −15 degrees, since each laser beam is simultaneously scanned through a different 5 degrees of elevation as discussed above. Besides reducing the trajectory simulation time by ⅓ to about ⅓ of a second in this Example, the scanning mirror scan needed only provide the equivalent to a motion needed for 5 degree scanning.

Figure 4A:
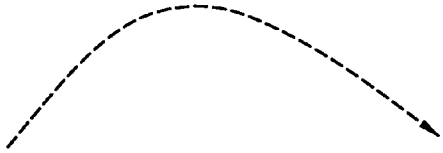
FIG. 4A (Prior Art)
Figure 4B:
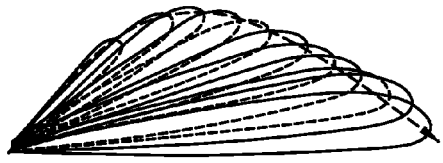
FIG. 4B (Prior Art)
FIG. 4B is a diagram showing a coarsely scanned trajectory simulation for a conventional laser-based firing simulation where the laser energy increases as the direction of the laser beam is scanned downward.

FIG. 4A is a diagram showing a general trajectory path of a projectile in the case of a bullet, while FIG. 4B is a diagram showing a coarsely scanned trajectory simulation for a conventional laser-based projectile trajectory simulation where the laser energy increases as the direction of the laser beam is scanned downward.

Figure 4C:
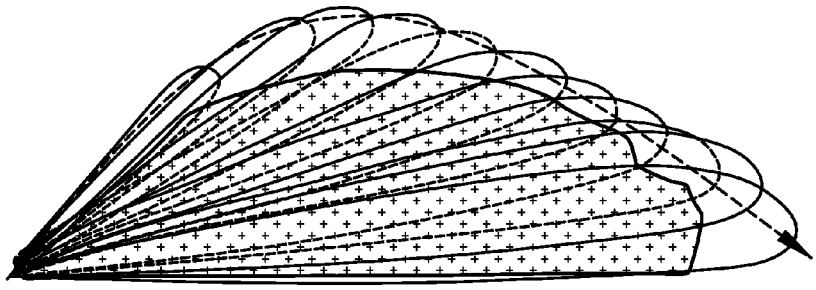
FIG. 4C (Prior Art)
FIG. 4C is a depiction of a scanned laser transmission for a conventional laser-based firing simulation that includes disrupted messages areas in which the scanned laser message cannot be interpreted therein.

The scanned laser transmission pattern shown in FIG. 4B has a limitation in that the scanned laser messaging must be disrupted as the simulated laser beam "bullet" could pass over an individual's head. This is conventionally accomplished by sending out disruption laser messages at a somewhat lower energy level than the actual messages. The effect of added disruption laser pulses in a conventional laser-based projectile trajectory simulation is shown in FIG. 4C. The darkened area has disrupted messages so that the scanned laser message cannot be interpreted therein.

Figure 4D:
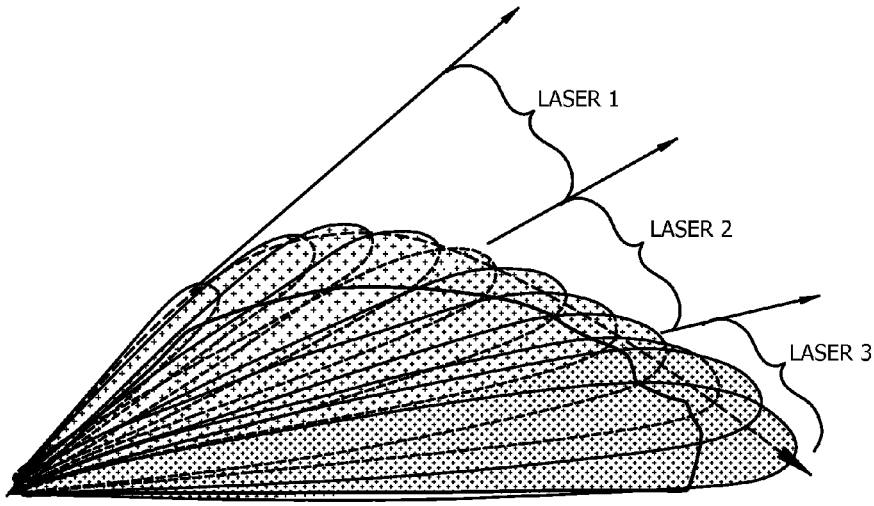
FIG. 4D is a depiction of a scanned laser transmission from a training weapon apparatus including a firing simulation apparatus comprising a tri-vectored scanner with added disruption laser pulses, that can be seen to correspond to the depiction shown in FIG. 4C, according to a disclosed embodiment.

FIG. 4D shows a scanned laser transmission pattern obtained from the training weapon apparatus including a firing simulation apparatus comprising a tri-vectored scanner with added disruption laser pulses, according to a disclosed embodiment. As in FIG. 4C, the darkened area represents areas that have disrupted messages so that the scanned laser message cannot be interpreted therein. Comparing the darkened areas in FIG. 4D to the darkened areas in FIG. 4C, it can be seen that multi-vector scanning does not change the disrupted message areas. Thus, with all three lasers being fired simultaneously, the scan time can be reduced by a factor of three (3) without changing simulation characteristics, such as the disrupted message area.

While various embodiments of the invention have been described above, it should be understood that they have been presented by way of example only, and not limitation. Numerous changes to the disclosed embodiments can be made in accordance with the disclosure herein without departing from the spirit or scope of the disclosed embodiments. Thus, the breadth and scope of embodiments of the invention should not be limited by any of the above explicitly described embodiments. Rather, the scope of the invention should be defined in accordance with the following claims and their equivalents.

Although the embodiments of invention have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting to embodiments of the invention. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the following claims.

The invention claimed is:

1. A firing simulation apparatus for simulating firing of a simulated projectile at a target that includes optical reflectance, comprising:

at least one scanning mirror for scanning at least an elevation angle;

a plurality of light generating devices for simultaneously emitting a first modulated light beam and at least a second modulated light beam, said plurality of light generating devices positioned so that their respective modulated light beams are incident on said scanning mirror at different elevation angles;

a photodetector for detecting reflected light from said target responsive to irradiation by said first modulated light beam and said second modulated light beam;

a simulation controller coupled to receive data obtained from said reflected light, said simulation controller generating a scan control signal based on said receive data and a simulated projectile trajectory path for said projectile to said target, and wherein said scan control signal is coupled to said scanning mirror for sequentially scanning said elevation angle of said scanning mirror so that said first modulated light beam and said second modulated light beam simultaneously scan different sectors of said simulated trajectory path to obtain a simulation that represents said simulated projectile trajectory path.

2. The apparatus of claim 1, wherein said different elevation angles provide an angular separation of at least 2 degrees.

3. The apparatus of claim 1, wherein said different elevation angles provide an angular separation of at least 10 degrees.

4. The apparatus of claim 1, wherein said at least one scanning mirror consists of a single scanning mirror.

5. The apparatus of claim 1, wherein said at least one scanning mirror comprises a plurality of said scanning mirrors.

6. The apparatus of claim 1, wherein said first modulated light beam is positioned to transmit along a more distant sector relative to a closer sector in which said second modulated light beam is positioned to transmit, and wherein a beam divergence of said second modulated light beam is larger than a beam divergence of said first modulated light beam.

7. The apparatus of claim 6, wherein said beam divergence of said second modulated light beam is at least 50% larger than said beam divergence of said first modulated light beam.

8. The apparatus of claim 1, wherein said plurality of light generating devices comprise a first light generating device for emitting said first modulated light beam, a second light generating device for emitting said second modulated light beam, and at least a third light generating devices for emitting a third modulated light beam.

9. A weapon for training, comprising:

a barrel for shooting a simulated projectile; and a firing simulation apparatus for simulating firing of a weapon that shoots a projectile at a target that includes reflectance affixed to said barrel, said firing simulation apparatus comprising:

at least one scanning mirror for scanning at least an elevation angle;

a plurality of light generating devices for simultaneously emitting a first modulated light beam and at least a second modulated light beam, said plurality of light generating devices positioned so that their respective modulated light beams are incident on said scanning mirror at different elevation angles;

a photodetector for detecting reflected light from said target responsive to irradiation by said first modulated light beam and said second modulated light beam;

a simulation controller coupled to receive data obtained from said reflected light, said simulation controller generating a scan control signal based on said receive data and a projectile trajectory path for said projectile to said target, and wherein said scan control signal is coupled to said scanning mirror for sequentially scanning said elevation angle of said scanning mirror so that said first modulated light beam and said second modulated light beam simultaneously scan different sectors of said simulated trajectory path to obtain a simulation that represents said projectile trajectory path.

10. The weapon of claim 9, wherein said different elevation angles provide an angular separation of at least 2 degrees.

11. The weapon of claim 9, wherein said at least one scanning mirror consists of a single scanning mirror.

12. The weapon of claim 9, wherein said first modulated light beam is positioned to transmit along a more distant sector relative to a closer sector in which said second modulated light beam is positioned to transmit, and wherein a beam divergence of said second modulated light beam is at least 50% larger than a beam divergence of said first modulated light beam.

13. The weapon of claim 9, wherein said plurality of light generating devices comprise a first light generating device for emitting said first modulated light beam, a second light generating device for emitting said second modulated light beam, and at least a third light generating device for emitting a third modulated light beam.

14. A method of simulating firing of a simulated projectile at a target that includes reflectance, comprising:

simultaneously sequentially scanning an elevation angle of a first modulated light beam and at least a second modulated light beam, wherein said first modulated light beam and said second modulated light beam simultaneously scan different sectors of a simulated trajectory path for said projectile, further comprising using a plurality of light generating devices for simultaneously emitting said first modulated light beam and said second modulated light beam; and providing a photodetector for detecting reflected light from said target responsive to irradiation by said first modulated light beam and said second modulated light beam.

15. The method of claim 14, wherein a single scanning mirror is used for said sequential simultaneously scanning.

16. The method of claim 15, further comprising using a plurality of light generating devices for simultaneously emitting said first modulated light beam and at said second modulated light beam, wherein said plurality of light generating devices are positioned so that said first and said second modulated light beams are incident on said single scanning mirror at different elevation angles.

17. The method of claim 16, wherein said plurality of light generating devices comprise a first light generating device for emitting said first modulated light beam, a second light generating device for emitting said second modulated light beam, and at least a third light generating device for emitting a third modulated light beam.

18. The method of claim 16, wherein said wherein said different elevation angles provide an angular separation of at least 2 degrees.

19. The method of claim 16, wherein said different elevation angles provide an angular separation of at least 10 degrees.

20. The method of claim 14, wherein said first modulated light beam is positioned to transmit along a more distant sector relative to a closer sector in which said second modulated light beam is positioned to transmit, and wherein a beam divergence of said second modulated light beam is larger than a beam divergence of said first modulated light beam.

21. The method of claim 20, wherein said beam divergence of said second modulated light beam is at least 50% larger than said beam divergence of said first modulated light beam.

* * * * *